United States Patent [19]

May

[11] 4,043,530

[45] Aug. 23, 1977

[54] BOOK SUPPORT

[76] Inventor: Edward Eric May, R.D. 2, Box 242, Pine Bush, N.Y. 12566

[21] Appl. No.: 740,498

[22] Filed: Nov. 10, 1976

[51] Int. Cl.[2] ..... A47B 97/04

[52] U.S. Cl. ..... 248/453

[58] Field of Search ..... 248/441 R, 441 A, 441 B, 248/441 C, 441 D, 452, 453, 444, 445

[56] References Cited

U.S. PATENT DOCUMENTS

| | | | |
|---|---|---|---|
| 1,300,045 | 4/1919 | Tavi | 248/441 C |
| 2,012,551 | 8/1935 | Steen | 248/452 |
| 2,802,295 | 8/1957 | Kravs | 248/453 |
| 3,863,882 | 2/1975 | Hatcher et al. | 248/441 A |
| 3,952,989 | 4/1976 | Hatcher | 248/453 |

FOREIGN PATENT DOCUMENTS

| | | | |
|---|---|---|---|
| 343,769 | 2/1931 | United Kingdom | 248/451 |

*Primary Examiner*—Robert A. Hafer
*Attorney, Agent, or Firm*—Jack D. Slobod

[57] ABSTRACT

A book support swivelably mounted on an elongated swinging arm includes a book support ledge having a pair of cutouts in which are mounted spring loaded page clamping blocks. The blocks are slideably mounted around axles in the cutouts and may be rotated about the axles to either extend above the ledge for clamping action or to be generally in line with the top of the ledge to allow pages to be turned.

2 Claims, 3 Drawing Figures

BOOK SUPPORT

FIELD OF THE INVENTION

The present invention relates generally to book stands or supports having a ledge. In its particular aspects, the present invention relates to a book support having spring loaded page clamping blocks mounted in cutouts in the ledge.

BACKGROUND OF THE INVENTION

The prior art is aware of various book support devices having means for holding the book open. These prior art holding means have made it a cumbersome operation to turn the pages of books when desired. Further, some of the aforementioned devices have been quite complicated and expensive to manufacture. Others have not securely held open books of different thicknesses.

Further, the mounting arrangements for these prior art devices have not been generally suitable to enable the device to be mounted to a selected fixed object such as a wall and to be positioned at a widely variable location.

OBJECTS OF THE INVENTION

It is an object of the present invention to provide a support device for books, book-like journals, calendars, magazines, T.V. listings, etc., which includes means for securely holding a book or the like open substantially independent of the thickness of the book so as to obviate the need for a bookmark.

It is another object of the present invention to provide a book support device with easily manipulative means for selectively holding the book open or for allowing the pages of the book to be turned.

It is yet another object of the present invention to provide a book support device mounting arrangement which allows the book support to be widely variable in position and orientation.

SUMMARY OF THE INVENTION

Briefly, the aforementioned and other objects of the present invention are satisfied by providing a book support which includes a generally planar upright having a front surface for receiving the back of an open book. A ledge projects generally perpendicularly from the bottom of the upright to support the bottom of the book in a conventional manner.

According to the principles of the present invention, first and second spaced apart cutouts are provided in the ledge respectively in which are formed first and second clamps for engaging the side by side pages of the open book.

The cutouts open onto the front surface of the upright and first and second axles are respectively mounted therein directed perpendicular to the front surface. First and second apertured blocks are respectively mounted about the axles for sliding and rotary movement. Helical springs disposed about the axles urge the blocks toward the front surface of the upright.

The blocks may be rotated about the axles selectively to first and second orientations. by shaping the blocks as rectangular and/or by mounting them eccentrically about the axles, the blocks, in the first orientation, extend significantly above the ledge for engaging the side by side pages of the book. However, in the second orientation, the upper surfaces of the blocks are generally in line with the upper surface of the ledge to provide clearance for turning the pages of the book.

In view of the mechanization of the clamps as spring loaded blocks slideable along axles, it is possible for the blocks to securely engage books of widely different thicknesses.

For enabling the book support to be mounted in a manner that it may be widely adjusted in location and orientation an elongated generally horizontal swinging bar is provided having a downwardly bent end for rotatable mounting in a bracket to be secured to a wall or other stable object. The other end of the bar is bent upwardly and is rotatably received in a generally vertical bore in the bottom of the book support. Thus, rotation of the bar is enabled about the downwardly directed end of the bar and rotation of the book support is enabled about the upwardly directed end of the bar.

Other objects, features and advantages of the present invention will become apparent upon perusal of the following detailed description of the preferred embodiment thereof when taken in conjunction with the appended drawing wherein:

DETAILED DESCRIPTION OF THE PREFERRED EMBODIMENT

Figure 1:
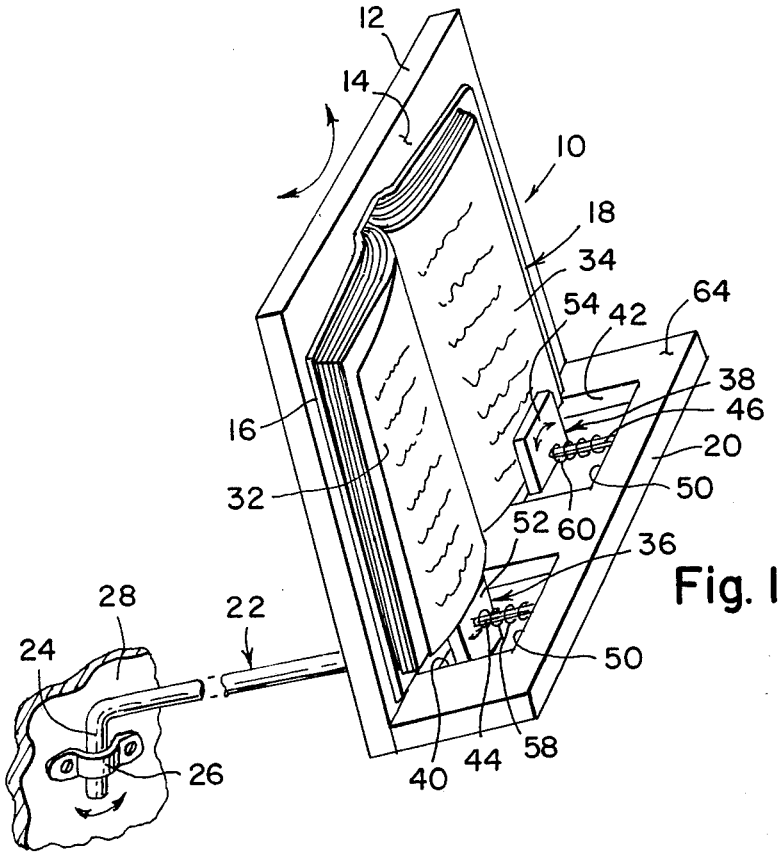
FIG. 1 is a generally elevational pictorial presentation of the book support of the present invention in conjunction with a book.
Figure 2:
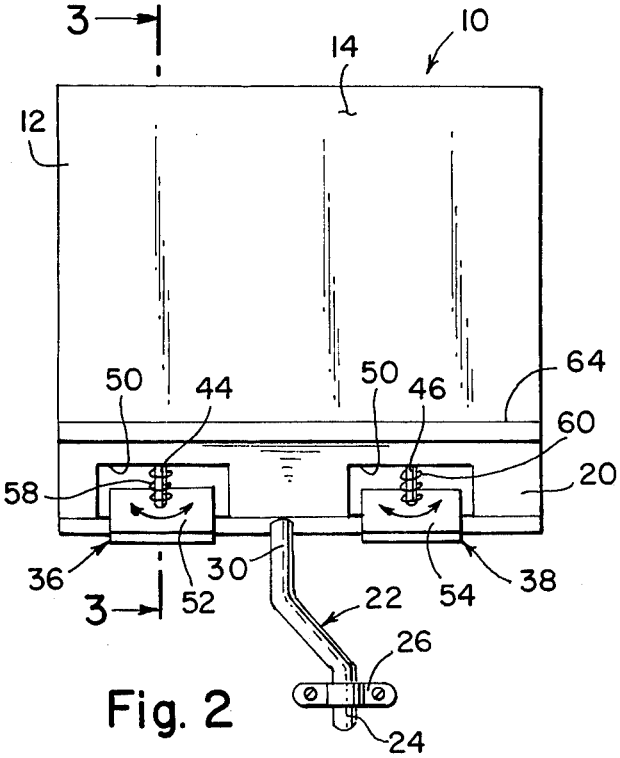
FIG. 2 is a front elevational view of the book support in FIG. 1 but with the book removed.
Figure 3:
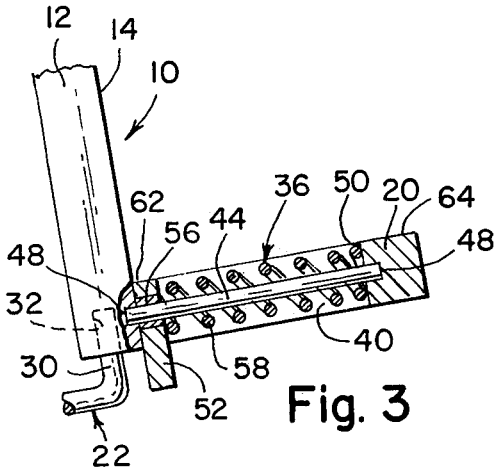
FIG. 3 is a fragmentary cross-sectional side elevational view of the book support taken through the lines 3—3 in FIG. 2.

With reference to FIGS. 1–3 of the drawing, the book support 10 of the present invention generally comprises a generally planar upright member or board 12 having a front surface 14 for receiving the back or binding 16 of an open book 18 or similar article such as a book-like journal, calendar, magazine, T.V. listing, etc. A ledge 20 projects perpendicularly from surface 14 at the bottom of upright member 12. Member 12 and ledge 20 may be fashioned of any suitable rigid materials and are fixedly joined together by screws, dowels, glue or other suitable fastening.

The book support 10 is mounted swivelably on an elongated generally horizontal swinging bar or arm 22 which maintains the support inclined preferably about 10° rearward. The bar 22 has a downwardly directed bent portion 24 which is rotatably received in a bracket 26 for attachment to a wall 28 or other stable object. The other end 30 of bar 22 is bent upward and is rotatably received in a bore 32 in the bottom center of upright 12 which enables support 10 to be rotated about end 30 as an axle.

For selectively clamping the book 18 open by engaging the side by side pages 32, 34 thereof, similar clamps 36, 38 are respectively formed in spaced apart rectangular cutouts 40, 42 in ledge 20. Cutouts 40, 42 open onto surface 14 and axles or rods 44, 46 are respectively mounted in the center of the cutouts directed perpendicular to surface 14. As best shown in FIG. 3, the opposite ends of axles 44, 46 are received in dimples or short bores 48 formed in surface 14 and in the front wall 50 of the cutouts.

Blocks 52, 54 are respectively, rotatably and slideably, mounted on the axles 44, 46 which pass through press-fitted bushings 56 in the blocks. Helical springs 58, 60 are respectively disposed about axles 44, 46 and act between the blocks 52, 54 and the cutout surface 50 for independently urging the blocks toward the upright front surface 14.

The bushings 56 are preferably eccentrically located in the blocks 52, 54 to such a degree that in one angular orientation of the blocks as shown in FIG. 1 and in FIG. 2, the top surface 62 of block 52 is generally in line with the top surface 64 of ledge 20 to provide clearance for the page 32 to be turned. However, in another angular orientation, wherein the block is rotated 180° (or incidentally 90°) as illustrated in FIG. 1, the block 54 extends significantly above the top surface 64 of the ledge and engages the page 34 for clamping action.

It will be appreciated that the aforementioned techniques of configuring the blocks 52, 54 to be rotated to one angular position for clearing the pages of book 18 and another angular position for engaging the pages may be mechanized in various different ways. I prefer to utilize rectangular shaped blocks and to eccentrically mount them as illustrated. Also, blocks of semi-circular shape have proven to be acceptable.

It should be appreciated that since the blocks 52, 54 are slideable along the axles 44, 46 the clamps 36, 38 are operable over a wide range of thickness of book 18.

While the preferred embodiment of the present invention has been described in specific detail, it should be noted that numerous modifications, additions and omissions in the details thereof are possible within the intended spirit and scope of the present invention. For example, the bracket 26 might be mounted either to a stationary object or to a stable moveable object such as a cart. Also, the bracket 26 and the end of the bar 22 might be configured as a ball joint to enable elevational adjustment of book support 10 for the comfort of the user. Accordingly, the following claims define the invention.

I claim:

1. A support device for books and the like comprising: upright means having a front surface for receiving the back of an open book; ledge means projecting generally perpendicularly from said upright means, said ledge means having a top surface for supporting the bottom of said book; said ledge means having first and second spaced apart cutouts opening onto said front surface; and first and second clamp means respectively mounted in said first and second cutouts for holding said book open by respectively engaging side by side pages of said book; said first and second clamp means respectively comprising: first and second axles respectively mounted in said first and second cutouts directed generally perpendicular to said front surface; first and second apertured blocks respectively mounted about said first and second axles for sliding movement along said axles; first and second helical springs disposed respectively about said first and second axles; and first and second helical springs being located for respectively urging said first and second blocks toward said front surface; said first and second blocks being respectively selectively rotatable about said axles to first and second orientations, said blocks being shaped in a manner that said first orientation is characterized by said blocks extending above said top surface for engaging said pages and said second orientation is characterized by upper surfaces of said blocks being generally in line with the upper surface of said ledge means in order that said blocks do not engage said pages.

2. The device of claim 1 further comprising an elongated bar adapted to be oriented generally horizontally; first and second portions at opposite ends of said bar bent in opposite directions; said first portion being directed upwardly and said second portion being directed downwardly when said bar is oriented generally horizontally; the bottom of said upright having a bore for rotatably receiving said first portion; and wall bracket means for rotatably receiving said second portion.

* * * * *